US011380221B2

(12) United States Patent
Wang

(10) Patent No.: US 11,380,221 B2
(45) Date of Patent: Jul. 5, 2022

(54) DISPLAY DEVICE, STRETCHABLE DISPLAY PANEL AND MANUFACTURING METHOD THEREOF

(71) Applicant: BOE TECHNOLOGY GROUP CO., LTD., Beijing (CN)

(72) Inventor: Pinfan Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 83 days.

(21) Appl. No.: 16/903,605

(22) Filed: Jun. 17, 2020

(65) Prior Publication Data

US 2020/0410907 A1 Dec. 31, 2020

(30) Foreign Application Priority Data

Jun. 27, 2019 (CN) ..... 201910569139.0

(51) Int. Cl.
*G09F 9/30* (2006.01)

(52) U.S. Cl.
CPC ..... *G09F 9/301* (2013.01)

(58) Field of Classification Search
CPC ..... G09F 9/30; G09F 9/301; G06F 1/1652
See application file for complete search history.

(56) References Cited

U.S. PATENT DOCUMENTS 11,127,804 B2 * 9/2021 Wang ..... H01L 27/3258
2013/0093697 A1 * 4/2013 Sun ..... G06F 3/0412 345/173
2013/0299789 A1 * 11/2013 Yamazaki ..... H01L 27/3258 257/40
2016/0087237 A1 * 3/2016 Oh ..... H01L 51/0023 257/40
2016/0101593 A1 * 4/2016 Nam ..... B32B 3/04 428/213
2016/0155966 A1 * 6/2016 Kim ..... H01L 51/5253 257/40
2016/0211483 A1 * 7/2016 Kwon ..... H01L 27/3276
2016/0233453 A1 * 8/2016 Lee ..... H01L 27/3225
2017/0032763 A1 * 2/2017 Cheong ..... G02F 1/133305
(Continued)

FOREIGN PATENT DOCUMENTS

CN 103064552 A 4/2013
CN 206116400 U 4/2017
(Continued)

OTHER PUBLICATIONS

First Office Action for CN Patent Application No. 201910569139.0 dated Nov. 13, 2020.

*Primary Examiner* — Joe H Cheng
(74) *Attorney, Agent, or Firm* — Thomas | Horstemeyer LLP

(57) ABSTRACT

A stretchable display panel includes a first elastic layer, a stretchable display layer and a second elastic layer. The display layer has a display area and a non-display area surrounding the display area. The first elastic layer is disposed on a side of the display layer and is fixedly connected to the non-display area. The first elastic layer is disposed on a side of the display layer and is fixedly connected to the non-display area. The second elastic layer is disposed on a side of the display layer distal to the first elastic layer, and is fixedly connected to the non-display area.

14 Claims, 7 Drawing Sheets

(56) References Cited

U.S. PATENT DOCUMENTS

| | | | | |
|---|---|---|---|---|
| 2017/0222178 | A1* | 8/2017 | Kang | H01L 27/3276 |
| 2018/0130974 | A1* | 5/2018 | Koo | G06F 1/1652 |
| 2020/0272202 | A1* | 8/2020 | Wang | G06F 1/1652 |
| 2021/0159221 | A1* | 5/2021 | Li | H01L 25/18 |

FOREIGN PATENT DOCUMENTS

| | | | |
|---|---|---|---|
| CN | 107768362 | A | 3/2018 |
| CN | 108766951 | A | 11/2018 |
| CN | 109003951 | A | 12/2018 |
| CN | 109326564 | A | 2/2019 |
| KR | 20170036875 | A | 4/2017 |
| WO | 2011008459 | A2 | 1/2011 |

* cited by examiner

DISPLAY DEVICE, STRETCHABLE DISPLAY PANEL AND MANUFACTURING METHOD THEREOF

CROSS-REFERENCE TO RELATED APPLICATIONS

The present application claims the benefit of and priority to Chinese Patent Application No. 201910569139.0 filed Jun. 27, 2019, the contents of which are incorporated by reference in their entirety herein.

TECHNICAL FIELD

The present disclosure generally relates to the field of display technology and, more particularly, to a display device, a stretchable display panel, and a method for manufacturing the stretchable display panel.

BACKGROUND

At present, flexible display panels have gained extensive attention. Flexible display panels may be used in wearable devices, such as watches to adapt to body movements, or used in products such as electronic papers since they are deformable, e.g., stretchable and bendable.

Stretchable display panels are important research directions. An existing stretchable display panel is generally divided into a plurality of display units by apertures. The flexible display panel and the stretchable display panel may be stretched and thereby deformed due to the apertures.

It should be noted that the above-mentioned information disclosed in this part are provided only for acquiring a better understanding of the background of the present application and therefore, may include information that is not current technology already known to those of ordinary skill in the art.

SUMMARY

According to an aspect of the present disclosure, there is provided a stretchable display panel, comprising:

a stretchable display layer comprising a display area and a non-display area surrounding the display area;

a first elastic layer disposed on a side of the display layer and fixedly connected to the non-display area; and a second elastic layer disposed on a side of the display layer distal to the first elastic layer, and fixedly connected to the non-display area;

wherein both the first elastic layer and the second elastic layer are transparent materials and have a Young's modulus greater than that of the display layer.

In an exemplary embodiment of the present disclosure, the stretchable display panel further comprises:

a first plastic frame sandwiched between the first elastic layer and the display layer, and located in the non-display area, the first plastic frame being in a ring-shape, wherein the first elastic layer is fixedly connected to the non-display area through the first plastic frame; and a first filling portion filled in a space enclosed by the first plastic frame, and the first filling portion being liquid or solid having a Young's modulus is not greater than that of the display layer.

In an exemplary embodiment of the present disclosure, the stretchable display panel further comprises:

a second plastic frame sandwiched between the second elastic layer and the display layer, and located in the non-display area, the second plastic frame being in a ring-shape, wherein the second elastic layer is fixedly connected to the non-display area through the second plastic frame; and a second filling portion filled in a space enclosed by the second plastic frame, and the second filling portion being liquid or solid having a Young's modulus not greater than that of the display layer.

In an exemplary embodiment of the present disclosure, the display area of the display layer comprises a plurality of display units that are spaced apart and through-holes between the display units, wherein the first filling portion or the second filling portion is filled in the through-holes.

In an exemplary embodiment of the present disclosure, the first filling portion and the second filling portion are solid and the first filling portion and the second filling portion have a Young's modulus not less than 5 Mpa and not more than 500 Mpa.

In an exemplary embodiment of the present disclosure, a material of the first filling portion and the second filling portion comprises at least one of polyvinyl chloride, acrylic, and polysulfide.

In an exemplary embodiment of the present disclosure, the first filling portion and the second filling portion are liquid and the first filling portion and the second filling portion have a viscosity not less than 10 cps and not more than 1000 cps.

In an exemplary embodiment of the present disclosure, a material of the first filling portion and the second filling portion comprises a lubricating oil.

In an exemplary embodiment of the present disclosure, the Young's moduli of the first elastic layer and the second elastic layer are not less than 500 Mpa and not more than 5000 Mpa.

In an exemplary embodiment of the present disclosure, a material of the first elastic layer comprises at least one of polydimethylsiloxane, polyurethane, rubber, and polysulfide; and a material of the second elastic layer comprises at least one of polydimethylsiloxane, polyurethane, rubber, and polysulfide.

In an exemplary embodiment of the present disclosure, the first elastic layer and the second elastic layer have a thickness not less than 20 μm and not more than 200 μm; and the display layer has a thickness not less than 5 μm and not more than 20 μm.

According to an aspect of the present disclosure, there is provided a method for manufacturing a stretchable display panel, comprising:

providing a substrate and a stretchable display layer comprising a display area and a non-display area surrounding the display area;

forming a first elastic layer on the substrate, the first elastic layer being a transparent material and having a Young's modulus greater than that of the display layer;

providing the display layer on a side of the first elastic layer distal to the substrate, and the first elastic layer being fixedly connected to the non-display area;

forming a second elastic layer on a side of the display layer distal to the substrate, the second elastic layer being fixedly connected to the non-display area, and the second elastic layer being a transparent material and having a Young's modulus greater than that of the display layer; and peeling off the substrate from the first elastic layer.

In an exemplary embodiment of the present disclosure, providing the display layer on a side of the first elastic layer distal to the substrate, and the first elastic layer being fixedly connected to the non-display area, comprises:

forming a ring-shaped first plastic frame on a surface of the first elastic layer distal to the substrate, the first plastic frame being located in the non-display area;

filling a first filling portion in the first plastic frame, the first filling portion being liquid or solid having a Young's modulus not greater than that of the display layer;

providing the display layer on a surface of the first plastic frame distal to the substrate, wherein the first elastic layer is fixedly connected to the non-display area through the first plastic frame;

forming the second elastic layer on a side of the display layer distal to the substrate, the second elastic layer being fixedly connected to the non-display area, comprises:

forming a ring-shaped second plastic frame on a surface of the display layer distal to the substrate, the second plastic frame being located in the non-display area;

filling a second filling portion in the second plastic frame, the second filling portion being liquid or solid having a Young's modulus not greater than that of the display layer;

forming a second elastic layer on a side of the second plastic frame distal to the substrate, the second elastic layer being fixedly connected to the non-display area through the second plastic frame.

In an exemplary embodiment of the present disclosure, providing the display layer on a side of the first elastic layer distal to the substrate, and the first elastic layer being fixedly connected to the non-display area, comprises:

forming a ring-shaped first plastic frame on a surface of the first elastic layer distal to the substrate, the first plastic frame being located in the non-display area;

providing the display layer on a surface of the first plastic frame distal to the substrate, wherein the first elastic layer is fixedly connected to the non-display area through the first plastic frame;

forming the second elastic layer on a side of the display layer distal to the substrate, the second elastic layer being fixedly connected to the non-display area, comprises:

forming a ring-shaped second plastic frame on a surface of the display layer distal to the substrate, the second plastic frame being located in the non-display area, and the second plastic frame having a notch;

forming a second elastic layer on a surface of the second plastic frame distal to the substrate, the second elastic layer being fixedly connected to the non-display area through the second plastic frame;

before peeling off the substrate from the first elastic layer, after forming the second elastic layer on the surface of the second plastic frame distal to the substrate, the method further comprises:

injecting a transparent liquid filler into the notch, wherein a portion of the transparent filler filled in the first plastic frame is a first filling portion and a portion of the filler filled in the second plastic frame is a second filling portion; and blocking the notch.

According to an aspect of the present disclosure, there is provided a display device comprising the stretchable display panel according to any one of the above described.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments consistent with the invention and, together with the description, serve to explain the principles of the invention. Understandably, the drawings described below are only for illustrating some embodiments of the present disclosure and those of ordinary skill in the art can also derive other drawings based on the drawings without paying any creative labor.

DETAILED DESCRIPTION

Figure 1:
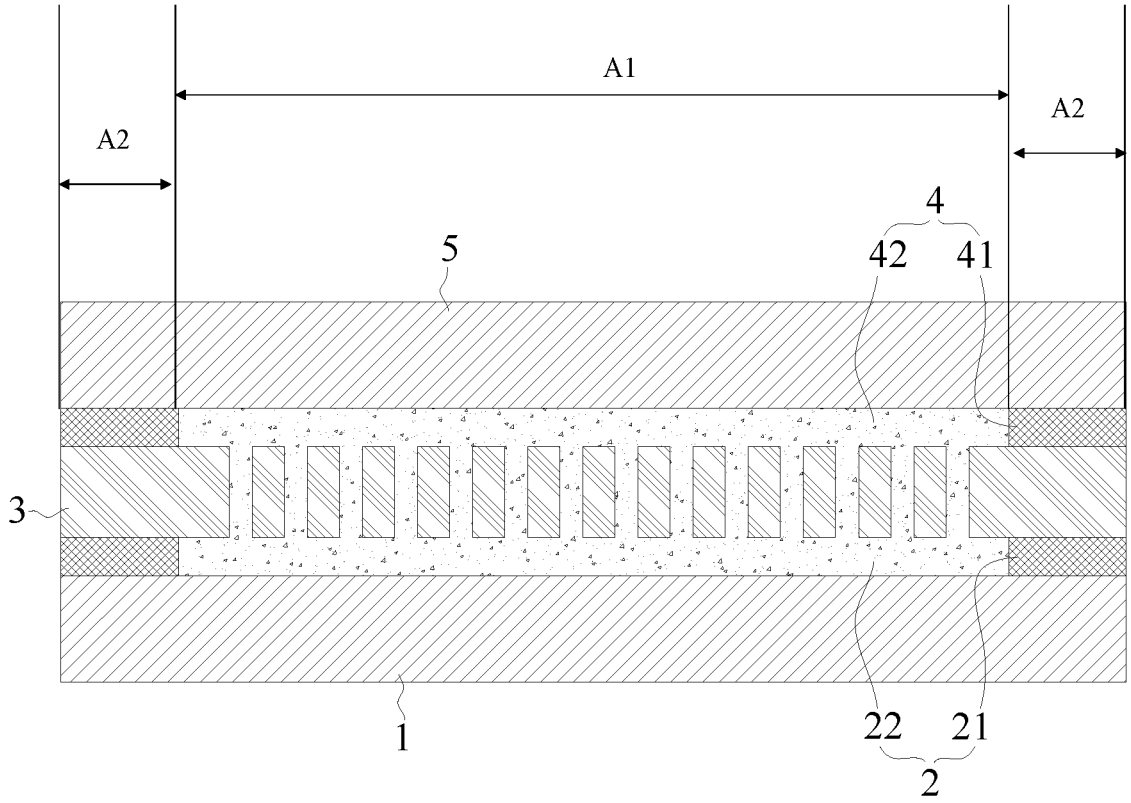
FIG. 1 is a diagram of a stretchable display panel according to an embodiment of the present disclosure.

Exemplary embodiments will now be described more fully by reference to the accompanying drawings. However, the exemplary embodiments can be implemented in various forms and should not be understood as being limited to the examples set forth herein. Rather, the embodiments are provided so that this disclosure will be thorough and complete, and the conception of the exemplary embodiments will be fully conveyed to those skilled in the art. The same reference signs in the drawings denote the same or similar structures and detailed description thereof will be omitted. In addition, the drawings are merely schematic illustrations of the present disclosure and are not necessarily drawn to scale.

Although terms having opposite meanings such as "up" and "down" are used in the description to describe the relationship of one component relative to another component, such terms are used herein only for the sake of convenience, for example, "in the direction illustrated in the figure." It can be understood that if a device denoted in the drawings is turned upside down, a component described as "above" something will become a component described as "under" something. When a structure is "on" another structure, it probably means that the structure is integrally formed on another structure, or, the structure is "directly" disposed on another structure, or, the structure is "indirectly" disposed on another structure through an additional structure.

Words such as "one," "an/a," "the," "said," and "at least one" are used herein to indicate the presence of one or more elements, component parts, and others. The terms "including" and "having" have an inclusive meaning which means that there may be additional elements, component parts, and others in addition to the listed elements, component parts, and others. The terms "first," "second," and others are used herein only as markers, and they do not limit the number of objects modified after them.

Figure 2:
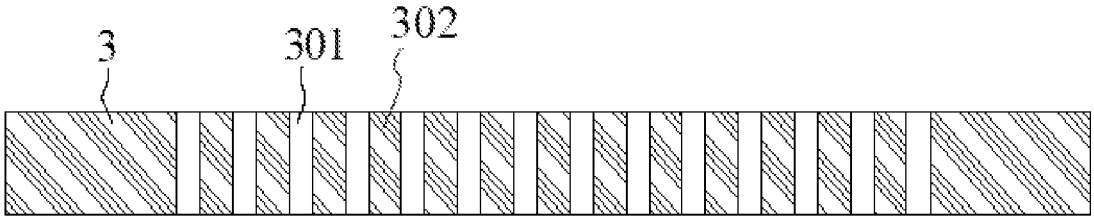
FIG. 2 is a diagram of a display layer of a stretchable display panel according to the present disclosure.

An embodiment of the present disclosure provides a stretchable display panel. As shown in FIGS. 1 and 2, the stretchable display panel includes a first elastic layer 1, a display layer 3, and a second elastic layer 5.

The display layer 3 is a stretchable structure, and includes a display A1 area and a non-display area A2 surrounding the display area. The first elastic layer 1 is disposed on a side of the display layer 3. The first elastic layer 1 is connected to the display layer 3 by a first connecting part 2. The first connecting part 2 is disposed in the non-display area A2. In an exemplary embodiment, the first connecting part 2 can be the first plastic frame 21 shown in FIG. 1.

The second elastic layer 5 is disposed on a side of the display layer 3 distal to the first elastic layer 1. The second elastic layer 5 is connected to the display layer 3 by a second connecting part 4. The second connecting part 4 is disposed in the non-display area A2. The second connecting part 4 is disposed in the non-display area A2. In an exemplary embodiment, the first connecting part 4 can be the second plastic frame 41 shown in FIG. 1.

Furthermore, both the first elastic layer 1 and the second elastic layer 5 are made of transparent materials, and their Young's moduli are greater than that of the display layer 3.

In the stretchable display panel according to the embodiment of the present disclosure, the deformation of the display layer 3 in a direction perpendicular to the display layer 3, i.e., the deformation in a direction perpendicular to a stretching direction, may be restricted, a large deformation amount in the direction may be prevented, and damage to a display device or interlayer adhesive failure may be avoided, since the Young's moduli of the first elastic layer 1 and the second elastic layer 5 are greater than that of the display layer 3, thereby ensuring the display effect and improving product reliability.

Each part of the stretchable display panel according to the embodiment of the present disclosure will be described in detail below:

As shown in FIG. 2, the display layer 3 includes a plurality of display units 302 disposed to be spaced apart from one another and through-holes 301 between the display units. There are a plurality of through-holes 301, each of which is penetrated in a direction perpendicular to the display layer 3. The shape of the through-hole 301 is not particularly limited here as long as the display layer 3 is stretchable. Each of the display units 302 may include one or more light-emitting devices for displaying images. The light-emitting device may be an electroluminescent organic light-emitting device (OLED) and its structure is not particularly limited herein.

As shown in FIG. 1, the first elastic layer 1 and the second elastic layer 5 are both transparent elastic materials and their Young's moduli are greater than that of the display layer 3. Moreover, they are fixed on both sides of the display layer 3 so that the deformation of the display layer 3 in a direction perpendicular to the display layer 3 is restricted from both sides, that is, the deformation perpendicular to the stretching direction is restricted. For example, the Young's modulus of the first elastic layer 1 is not less than 500 Mpa and not more than 5000 Mpa and there may be 2%-50% of amount of elastic deformation. The material of the first elastic layer 1 may include at least one of polydimethylsiloxane, polyurethane, rubber, and polysulfide, and the material of the second elastic layer 5 may include at least one of polydimethylsiloxane, polyurethane, rubber, and polysulfide. Other elastic materials may also be certainly used.

The thicknesses of the first elastic layer 1 and the second elastic layer 5 are not less than 20 μm and not more than 200 μm. The thicknesses of the first elastic layer 1 and the second elastic layer 5 may be or may not be equal to each other. For example, the first elastic layer 1 and the second elastic layer 5 may have a thickness of 20 μm, 150 μm, 200 μm, etc. The display layer 3 has a thickness not less than 5 μm and not more than 20 μm, for example, 5 μm, 10 μm, or 20 μm.

Positions at which the first elastic layer 1 and the second elastic layer 5 are fixedly connected to the display layer 3 are in the non-display area of the display layer 3. The first elastic layer 1 and the second elastic layer 5 can be fixed to both sides of the display layer 3 through a plastic frame. As shown in FIG. 1, in one embodiment, the stretchable display panel may further include a first connection layer 2, which includes a first plastic frame 21 and a first filling portion 22.

The first plastic frame 21 is sandwiched between the first elastic layer 1 and the display layer 3, and is located in the non-display area of the display layer 3. The first plastic frame 21 is in a ring shape and an outer periphery of the first plastic frame 21 may be flush with or beyond an outer periphery of the first elastic layer 1, so that the first elastic layer 1 may be fixedly connected to the non-display area of the display layer 3 through the first plastic frame 21. Moreover, in order to ensure that the first plastic frame 21 does not hinder the tensile deformation of the display layer 3, the Young's modulus of the first plastic frame 21 is not greater than the Young's modulus of the display layer 3. The material of the first plastic frame 21 may be a UV adhesive, a thermosetting adhesive, or the like.

The first filling portion 22 is a transparent structure with the transparency of more than 90%, and may be filled in a space enclosed by the first plastic frame 21. The first filling portion 22 defines, buffers and can also support the display layer 3 in a direction perpendicular to the stretching direction, avoiding vacancy between the first elastic layer and the display area.

The first filling portion 22 may be liquid, such as lubricating oil or aerosol. If the liquid is lubricating oil, its viscosity is not less than 10 cps and not more than 1000 cps, such as 10 cps, 50 cps, 100 cps, or 1000 cps. If the first filling portion 22 is lyosol, its viscosity is not less than 10 cps and not more than 10000 cps.

Alternatively, the first filling portion 22 may also be solid whose Young's modulus is not greater than that of the display layer 3. The Young's modulus of the first filling portion 22 is not less than 5 MPa and not greater than 500 Mpa, for example, 5 Mpa, 10 Mpa, 100 Mpa, or 500 Mpa. The material of the first filling portion 22 may include at least one of polyvinyl chloride, acrylic, and polysulfide.

In other embodiments of the present disclosure, a first filling layer 2 may also be a continuous transparent layer, as long as it can transmit light and ensure the normal stretching of the display layer 3, and can also connect the first elastic layer 1 and the display layer 3.

As shown in FIG. 1, in one embodiment, the stretchable display panel of the present disclosure may further include a second connection layer 4. The second connection layer 4 includes a second plastic frame 41 and a second filling portion 42.

The second plastic frame 41 is sandwiched between the second elastic layer 5 and the display layer 3, and is located in the non-display area of the display layer 3. The second plastic frame 41 is in a ring-shape and an outer periphery of the second plastic frame 41 may be flush with or beyond an outer periphery of the second elastic layer 5, so that the second elastic layer 5 may be fixedly connected to the non-display area of the display layer 3 through the second plastic frame 41.

Projections of the second plastic frame 41 and the first plastic frame 21 on the same surface of the display layer 3 may coincide, so that the second plastic frame 41 and the first plastic frame 21 are oppositely disposed in a direction perpendicular to the display layer 3, making it beneficial to the force balance of the display layer 3. Furthermore, in order to ensure that the second plastic frame 41 does not hinder the tensile deformation of the display layer 3, the Young's modulus of the second plastic frame 41 is not greater than the Young's modulus of the display layer 3. The material of the second plastic frame 41 may be a UV adhesive, a thermosetting adhesive, or the like.

The second filling portion 42 is a transparent structure with the transparency of more than 90%, and may be filled in a space enclosed by the second plastic frame 41. The second filling portion 42 defines, buffers and can also support the display layer 3 in a direction perpendicular to the stretching direction, avoiding vacancy between the second elastic layer 5 and the display area. Moreover, the second filling portion 42 may also be filled in the through-holes 301 of the display layer 3, which increases the strength of the display layer 3 without affecting the stretching and thus avoids damage caused by stretching. The material of the first filling portion 22 may be certainly used to fill the through-holes 301 of the display layer 3.

The second filling portion 42 may be liquid, such as lubricating oil lyosol. If the liquid is lubricating oil, its viscosity is not less than 10 cps and not more than 1000 cps, such as 10 cps, 50 cps, 100 cps, or 1000 cps. If the second filling portion 42 is lyosol, its viscosity is not less than 10 cps and not more than 10000 cps.

Alternatively, the second filling portion 42 may also be solid whose Young's modulus is not greater than that of the display layer 3. For example, the Young's modulus of the second filling portion 42 is not less than 5 Mpa and not more than 500 Mpa, for example, 5 Mpa, 10 Mpa, 100 Mpa, or 500 Mpa. The material of the second filling portion 42 may include at least one of polyvinyl chloride, acrylic, and polysulfide.

In other embodiments of the present disclosure, the second connection layer 4 may also be a continuous adhesive layer, as long as it can transmit light and ensure the normal stretching of the display layer 3, and can also connect the second elastic layer 5 and the display layer 3.

Figure 3:
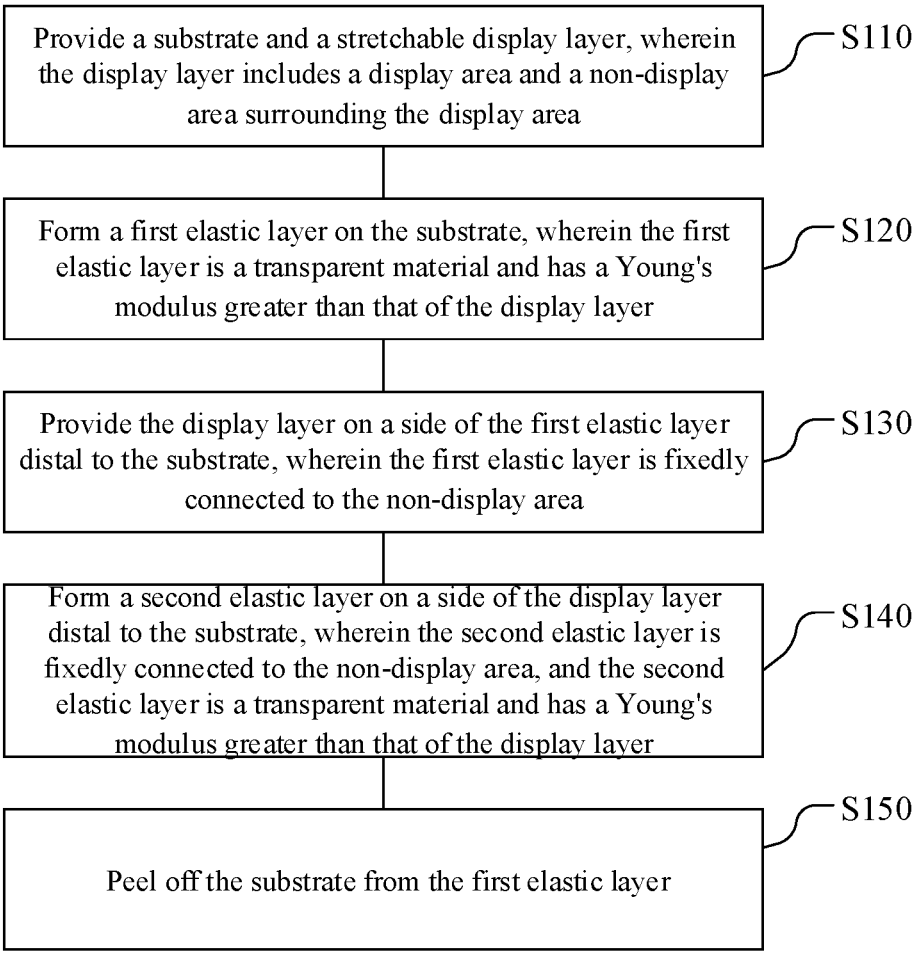
FIG. 3 is a flowchart of a manufacturing method according to an embodiment of the present disclosure.

Embodiments of the present disclosure provide a method for manufacturing a stretchable display panel. The stretchable display panel may be the stretchable display panel in the above-described embodiments and details of the stretchable display panel will not be described in detail here. As shown in FIG. 3, the manufacturing method includes steps S110-S150.

In step S110, a substrate and a stretchable display layer are provided, wherein the display layer includes a display area and a non-display area surrounding the display area.

In step S120, a first elastic layer is formed on the substrate, wherein the first elastic layer is a transparent material and has a Young's modulus greater than that of the display layer.

In step S130, the display layer is provided on a side of the first elastic layer distal to the substrate, wherein the first elastic layer is fixedly connected to the non-display area.

In step S140, a second elastic layer is formed on a side of the display layer distal to the substrate, wherein the second elastic layer is fixedly connected to the non-display area, and the second elastic layer is a transparent material and has a Young's modulus greater than that of the display layer.

In step S150, the substrate is peeled off from the first elastic layer.

For the beneficial effects of the manufacturing method according to the embodiment of the present disclosure, reference may be made to the beneficial effects of the stretchable display panel described above, which will not be described in detail here.

The steps of the manufacturing method according to the embodiment of the present disclosure will be described in detail below:

In step S110, a substrate and a stretchable display layer are provided, wherein the display layer includes a display area and a non-display area surrounding the display area.

As shown in FIG. 2, a substrate 100 may be a glass substrate. The substrate 100 may certainly be acrylic or other materials. The display layer 3 is a stretchable display panel and its specific structure and display principle are not particularly limited herein.

In step S120, a first elastic layer is formed on the substrate, wherein the first elastic layer is a transparent material and has a Young's modulus greater than that of the display layer.

Figure 6:
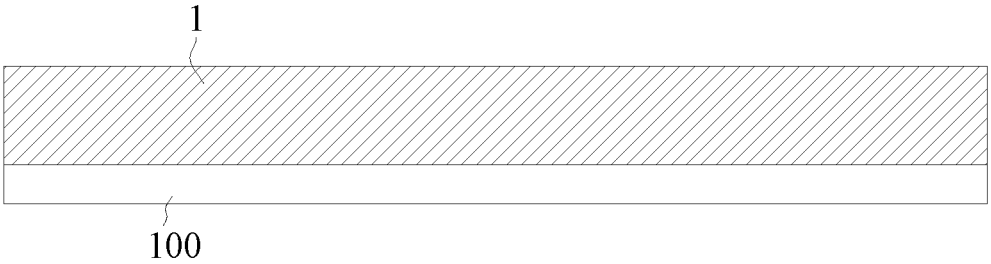
FIG. 6 is a diagram of step S120 in the manufacturing method of FIG. 3.

As shown in FIG. 6, the first elastic layer 1 may be made of the material of the first elastic layer 1 in the above-mentioned embodiment of the stretchable display panel. A first elastic coating may be coated on the substrate 100 at first and then the first elastic coating is cured by light irradiation or heating to obtain the first elastic layer 1.

In step S130, the display layer is provided on a side of the first elastic layer distal to the substrate, wherein the first elastic layer is fixedly connected to the non-display area.

For the specific structure of the display layer 3, reference may be made to the above-described embodiments of the stretchable display panel, which will not be elaborated here.

As shown in FIG. 1, the display layer 3 and the first elastic layer 1 may be fixed by the first plastic frame 21 and the first plastic frame 21 is filled with the first filling portion 22. For the specific structure, reference may be made to the above-described embodiment of the stretchable display panel.

Figure 4:
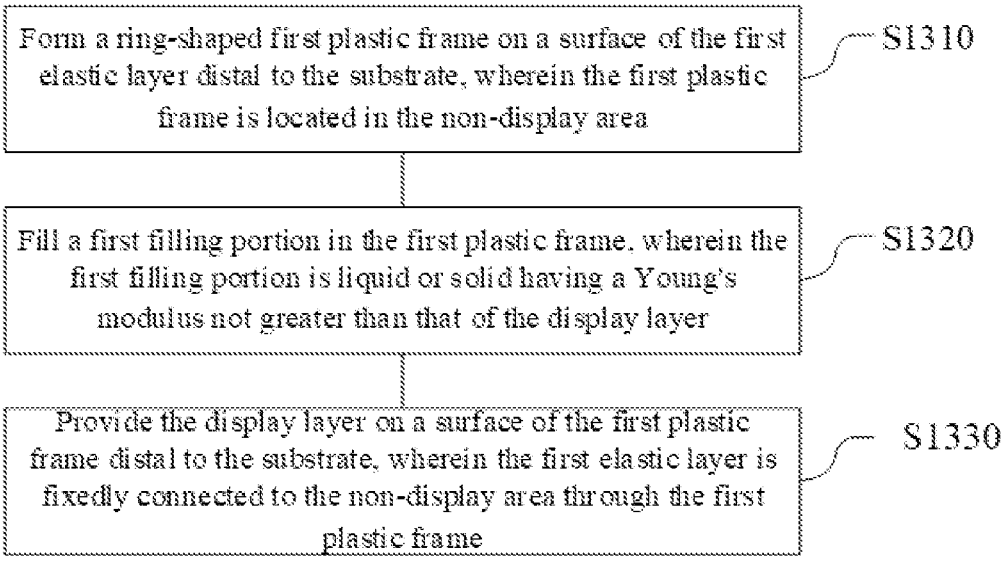
FIG. 4 is a flowchart of step S130 in the manufacturing method of FIG. 3.
Figure 5:
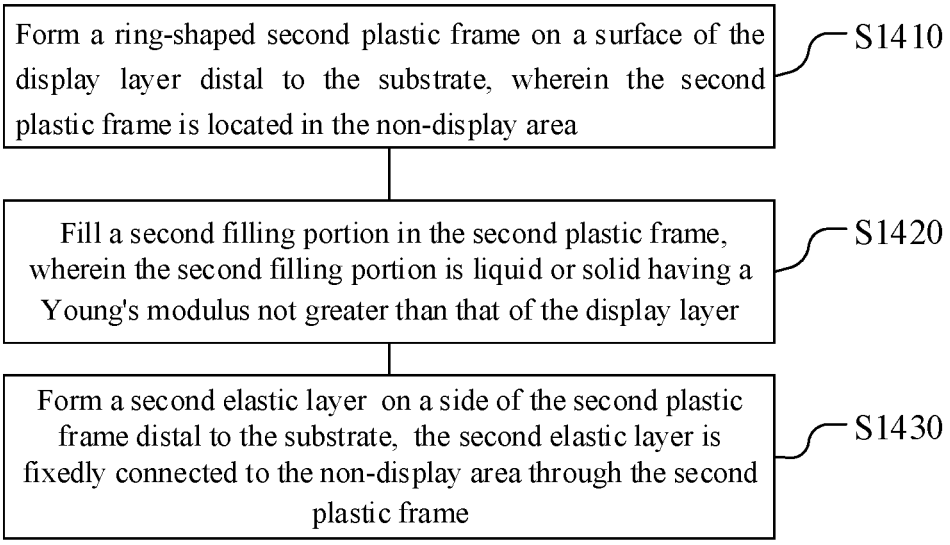
FIG. 5 is a flowchart of step S140 in the manufacturing method of FIG. 3.

In one embodiment, as shown in FIG. 4, step S130 includes steps S1310-S1330.

In step S1310, a ring-shaped first plastic frame is formed on a surface of the first elastic layer distal to the substrate, wherein the first plastic frame is located in the non-display area.

Figure 7:
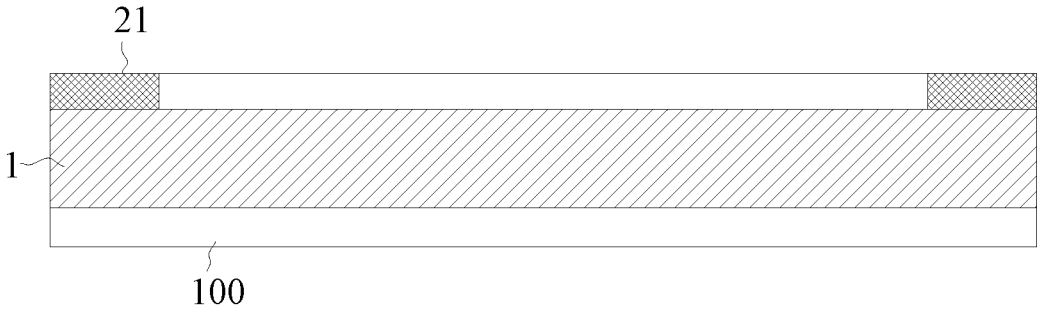
FIG. 7 is a diagram of step S1310 in the manufacturing method of FIG. 4.

As shown in FIG. 7, the first plastic frame 21 is sandwiched between the first elastic layer 1 and the display layer 3, and is located in the non-display area of the display layer 3. Moreover, the first plastic frame 21 is in a ring shape and an outer periphery of the first plastic frame 21 may be flush with or beyond an outer periphery of the first elastic layer 1, so that the first elastic layer 1 is fixedly connected to the non-display area of the display layer 3 through the first plastic frame 21. Furthermore, in order to ensure that the first plastic frame 21 does not hinder the tensile deformation of the display layer 3, the Young's modulus of the first plastic frame 21 is not greater than the Young's modulus of the display layer 3. The material of the first plastic frame 21 may be a UV adhesive, a thermosetting adhesive, or the like.

When the first plastic frame 21 is formed, an adhesive layer for forming the first plastic frame 21 may be coated on the surface of the first elastic layer 1 distal to the substrate 100 at first and then the adhesive layer is cured by heat curing, light curing or moisture curing to obtain the first plastic frame 21. The curing process depends on the material of the first plastic frame 21.

In step S1320, a first filling portion is filled in the first plastic frame, wherein the first filling portion is liquid or solid having a Young's modulus not greater than that of the display layer.

Figure 8:
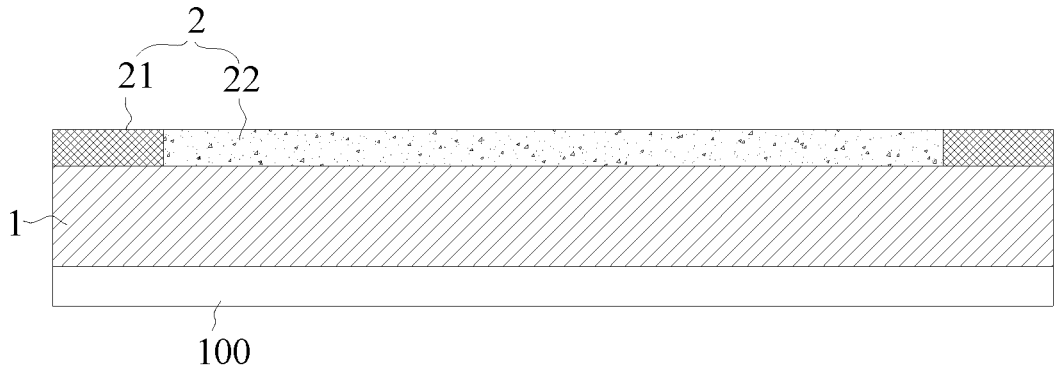
FIG. 8 is a diagram of step S1320 in the manufacturing method of FIG. 4.

As shown in FIG. 8, the first filling portion 22 is a transparent structure with the transparency of more than 90%, and may be filled in a space enclosed by the first plastic frame 21. The first filling portion 22 defines, buffers and can also support the display layer 3 in a direction perpendicular to the stretching direction, avoiding vacancy between the first elastic layer 1 and the display area.

The first filling portion 22 may be liquid, such as lubricating oil or lyosol. If the liquid is lubricating oil, its viscosity is not less than 10 cps and not more than 1000 cps, such as 10 cps, 50 cps, 100 cps, or 1000 cps. If the first filling portion 22 is lyosol, its viscosity is not less than 10 cps and not more than 10000 cps.

Alternatively, the first filling portion 22 may also be solid whose Young's modulus is not greater than that of the display layer 3. The Young's modulus of the first filling portion 22 is not less than 5 MPa and not greater than 500 Mpa, for example, 5 Mpa, 10 Mpa, 100 Mpa, or 500 Mpa. The material of the first filling portion 22 may include at least one of polyvinyl chloride, acrylic and polysulfide.

In step S1330, the display layer is provided on a surface of the first plastic frame distal to the substrate, wherein the first elastic layer is fixedly connected to the non-display area through the first plastic frame.

The display layer 3 may be attached to the surface of the first plastic frame 21 distal to the substrate 100, and to a surface of the first filling portion 22 distal to the substrate 100. The display layer 3 may be rolled and pressed by a roller so that the display layer 3 is tightly bonded thereto.

In step S140, a second elastic layer is formed on a side of the display layer distal to the substrate, wherein the second elastic layer is fixedly connected to the non-display area, and the second elastic layer is a transparent material and has a Young's modulus greater than that of the display layer.

Figure 9:
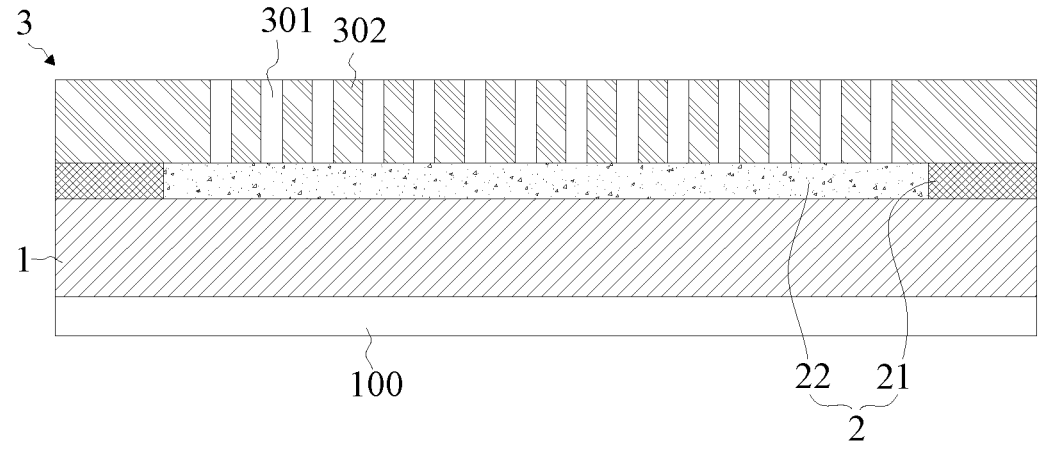
FIG. 9 is a diagram of step S1410 in the manufacturing method of FIG. 3.

In an embodiment, as shown in FIG. 9, the non-display area of the display layer 3 and the second elastic layer 5 may be fixedly connected by the second plastic frame 41 and the second filling portion 42 may be filled in the second plastic frame 41 to support the display layer 3. Specifically, step S140 may include steps S1410-S1430.

In step S1410, a ring-shaped second plastic frame is formed on a surface of the display layer distal to the substrate, wherein the second plastic frame is located in the non-display area.

Figure 10:
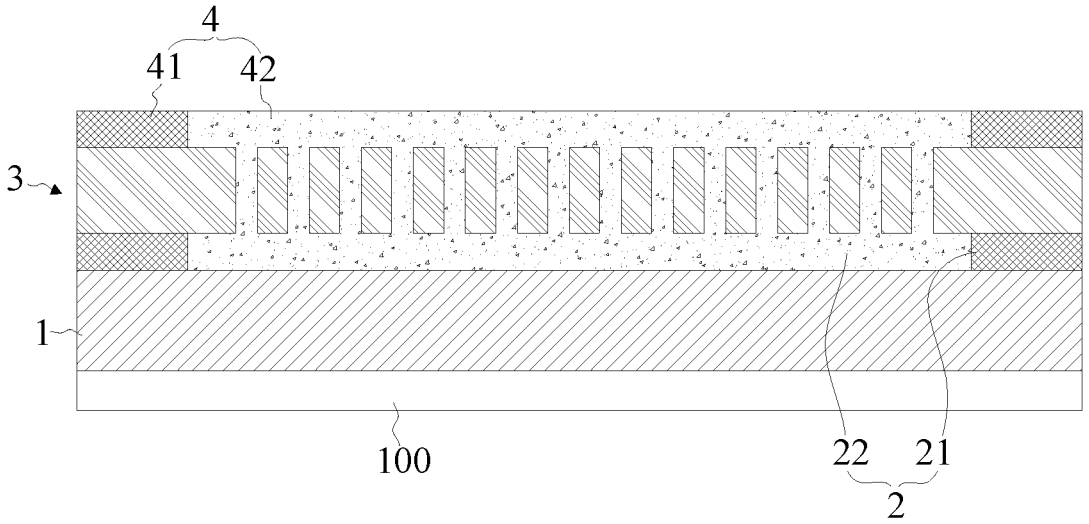
FIG. 10 is a diagram of step S1420 in the manufacturing method of FIG. 3.

As shown in FIG. 10, the second plastic frame 41 is sandwiched between the second elastic layer 5 and the display layer 3, and is located in the non-display area of the display layer 3. The second plastic frame 41 is in a ring-shape and an outer periphery of the second plastic frame 41 may be flush with or beyond an outer periphery of the second elastic layer 5, so that the second elastic layer 5 may be fixedly connected to the non-display area of the display layer 3 through the second plastic frame 41.

Projections of the second plastic frame 41 and the first plastic frame 21 on the same surface of the display layer 3 may coincide, so that the second plastic frame 41 and the first plastic frame 21 are oppositely disposed in a direction perpendicular to the display layer 3, making it beneficial to the force balance of the display layer 3. Furthermore, in order to ensure that the second plastic frame 41 does not hinder the tensile deformation of the display layer 3, the Young's modulus of the second plastic frame 41 is not greater than the Young's modulus of the display layer 3. The material of the second plastic frame 41 may be a UV adhesive, a thermosetting adhesive, or the like.

In step S1420, a second filling portion is filled in the second plastic frame, wherein the second filling portion is liquid or solid having a Young's modulus not greater than that of the display layer.

As shown in FIG. 10, the second filling portion 42 is a transparent structure with the transparency of more than 90%, and may be filled in a space enclosed by the second plastic frame 41. The second filling portion 42 defines, buffers and can also support the display layer 3 in a direction perpendicular to the stretching direction, avoiding vacancy between the second elastic layer 5 and the display area. Moreover, the second filling portion 42 may also be filled in the through-holes 301 of the display layer 3, which increases the strength of the display layer 3 without affecting the stretching and thus avoids damage caused by stretching. The material of the first filling portion 22 may be certainly used to fill the through-holes 301 of the display layer 3.

The second filling portion 42 may be liquid, such as lubricating oil aerosol. If the liquid is lubricating oil, its viscosity is not less than 10 cps and not more than 1000 cps, such as 10 cps, 50 cps, 100 cps, or 1000 cps. If the second filling portion 42 is lyosol, its viscosity is not less than 10 cps and not more than 10000 cps.

Alternatively, the second filling portion 42 may also be solid whose Young's modulus is not greater than that of the display layer 3. For example, the Young's modulus of the second filling portion 42 is not less than 5 Mpa and not more than 500 Mpa, for example, 5 Mpa, 10 Mpa, 100 Mpa, or 500 Mpa. The material of the second filling portion 42 may include at least one of polyvinyl chloride, acrylic and polysulfide.

In step S1430, a second elastic layer is formed on a side of the second plastic frame distal to the substrate, wherein the second elastic layer is fixedly connected to the non-display area through the second plastic frame.

As shown in FIG. 2, the second elastic layer 5 may be made of the material of the second elastic layer 5 in the above-mentioned embodiment of the stretchable display panel. If the second filling portion 42 is solid, a second elastic coating may be coated on a layered structure composed of the second plastic frame 41 and the second connection layer 42 at first and then the second elastic coating is cured by light irradiation or heating, to obtain the second elastic layer 5.

Alternatively, the prefabricated second elastic layer 5 may also be directly attached to a surface of the second connection layer 4 distal to the substrate 100 and may be rolled and pressed by a pressing device with a roller so that the second elastic layer 5 is closely adhered to the second plastic frame 41. It certainly can also be directly fixed on the surface of the display layer 3 without resorting to the second plastic frame 41.

In step S150, the substrate is peeled off from the first elastic layer.

As shown in FIG. 2, the process of separating the substrate 100 from the first elastic layer 1 is not particularly limited herein.

Figure 11:
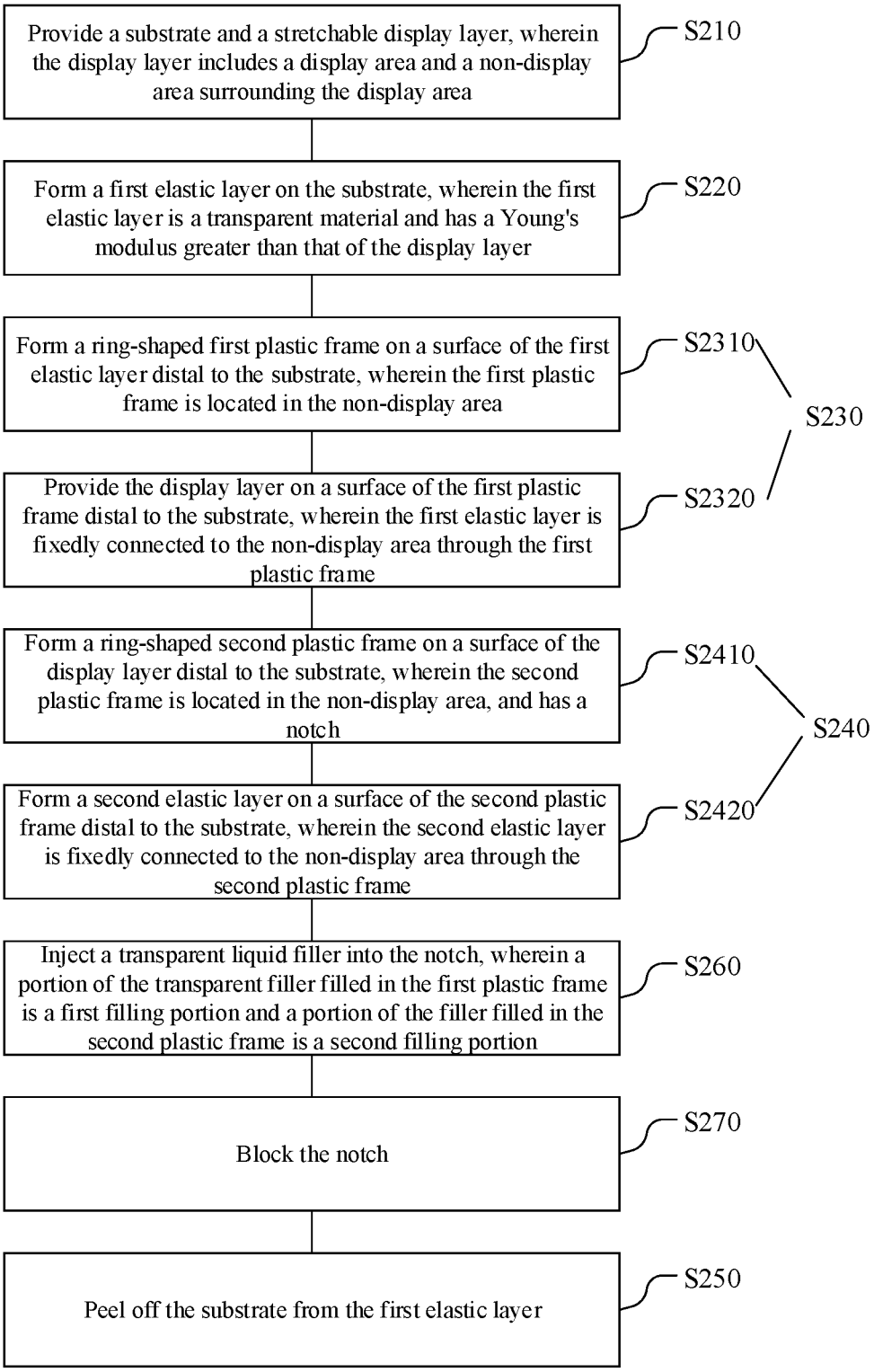
FIG. 11 is a flowchart of a manufacturing method according to another embodiment of the present disclosure.

As shown in FIG. 11, in another embodiment of the manufacturing method of the present disclosure, the manufacturing method may include steps S210-S270.

In step S210, a substrate and a stretchable display layer are provided, wherein the display layer includes a display area and a non-display area surrounding the display area.

In step S220, a first elastic layer is formed on the substrate, wherein the first elastic layer is a transparent material and has a Young's modulus greater than that of the display layer.

In step S230, the display layer is provided on a side of the first elastic layer distal to the substrate, wherein the first elastic layer is fixedly connected to the non-display area.

In step S240, a second elastic layer is formed on a side of the display layer distal to the substrate, wherein the second elastic layer is fixedly connected to the non-display area, and the second elastic layer is a transparent material and has a Young's modulus greater than that of the display layer.

In step S250, the substrate is peeled off from the first elastic layer.

In this embodiment, step S210 may be the same as step S110 described above, step S220 may be the same as step S120 described above and step S250 may be the same as step S150 described above, which will not be described in detail here.

Step S230 includes steps S2310 and S2320 described above, step S2310 may be the same as step S1310 described above and step S2320 may be the same as step S1320 described above. Therefore, the non-display area of the display layer 3 is fixedly connected to the first elastic layer 1 by the first plastic frame 21. For details of the first plastic frame 21, reference may be made to the first plastic frame 21 described above, which is not particularly limited herein.

Figure 12:
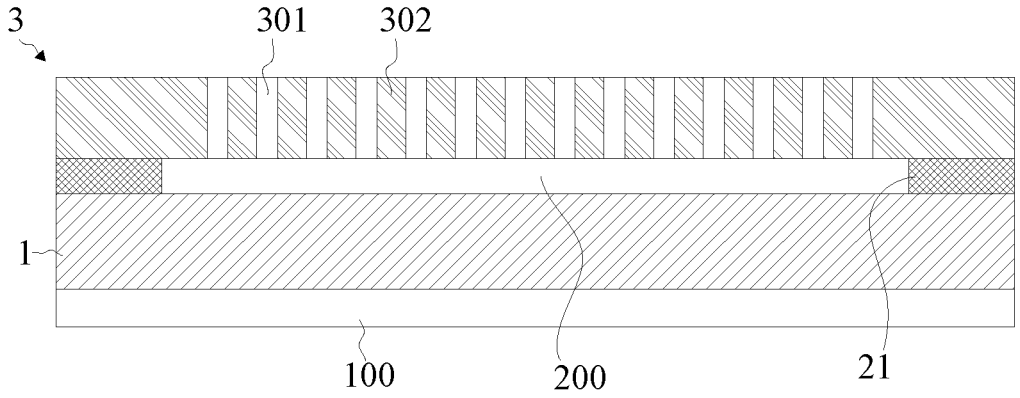
FIG. 12 is a diagram of step S230 in the manufacturing method of FIG. 11.

As shown in FIG. 12, the display layer 3 may be directly fixed on the surface of the first plastic frame 21 distal to the substrate 100 and a first cavity 200 is formed between the display layer 3, the first elastic layer 1 and the first plastic frame 21. Each of the through-holes 301 is in communication with the first cavity 200.

Step S240 of this embodiment may include steps S2410 and S2420.

In step S2410, a ring-shaped second plastic frame is formed on a surface of the display layer distal to the substrate, wherein the second plastic frame is located in the non-display area, and has a notch.

In step S2420, a ring-shaped second plastic frame is formed on a surface of the display layer distal to the substrate, wherein the second plastic frame is located in the non-display area, and has a notch.

Figure 13:
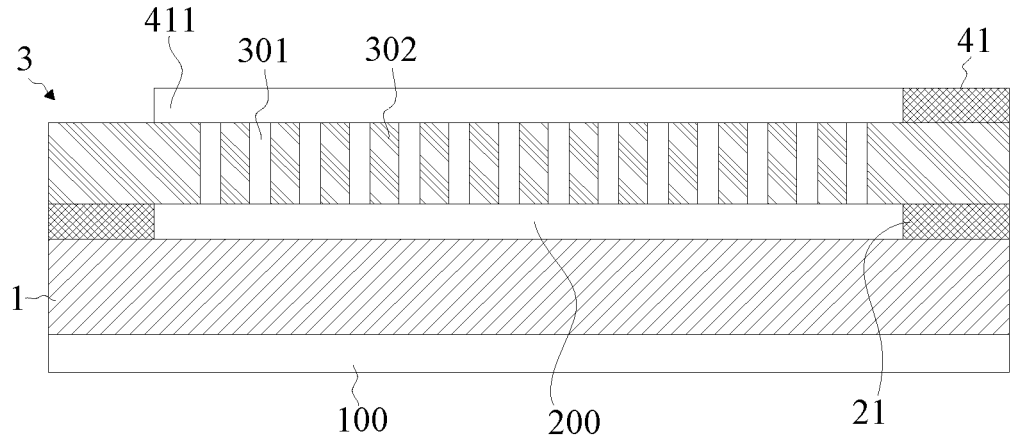
FIG. 13 is a diagram of step S2410 in the manufacturing method of FIG. 11.
Figure 14:
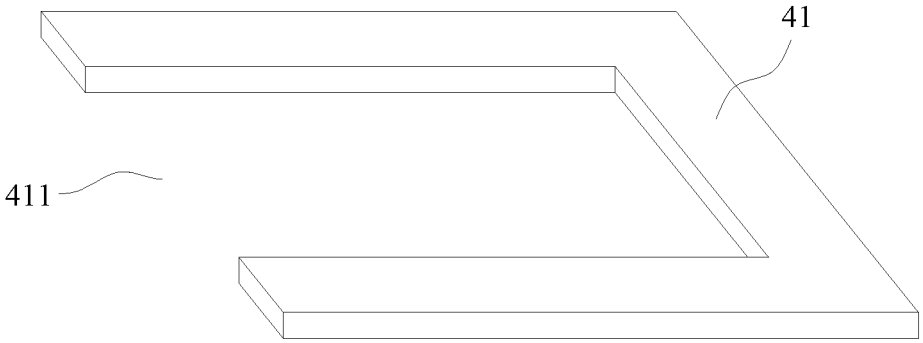
FIG. 14 is a diagram of a second plastic frame in the manufacturing method of FIG. 11.

As shown in FIGS. 13 and 14, the way of forming the second plastic frame 41 may refer to step S1420 described above, and will not be described in detail here. Furthermore, the second plastic frame 41 may have a notch 411, the shape and size of which may not be particularly limited here. It may communicate the interior and exterior of the second plastic frame 41.

In step S2420, a second elastic layer is formed on a surface of the second plastic frame distal to the substrate, wherein the second elastic layer is fixedly connected to the non-display area through the second plastic frame.

Figure 15:
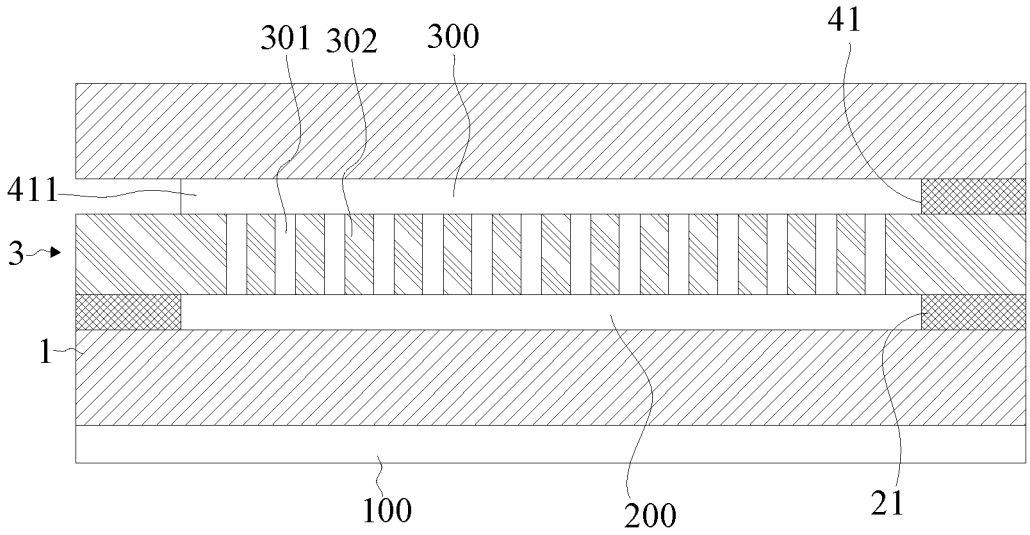
FIG. 15 is a diagram of step S2420 in the manufacturing method of FIG. 11.

As shown in FIG. 15, the second elastic layer 5 is a transparent material, and has a Young's modulus greater than that of the display layer 3. The prefabricated second elastic layer 5 may be disposed on the surface of the second plastic frame 41 distal to the substrate 100 and a second cavity 300 is formed between the display layer 3, the second elastic layer 5 and the second plastic frame 41. The cavity 300 is in communication with the first cavity 200 through the through-holes 301.

Meanwhile, before step S250 and after step S240, the manufacturing method of this embodiment further includes the following steps:

In step S260, a transparent liquid filler is injected into the notch, wherein a portion of the transparent filler filled in the first plastic frame is a first filling portion and a portion of the filler filled in the second plastic frame is a second filling portion.

Figure 16:
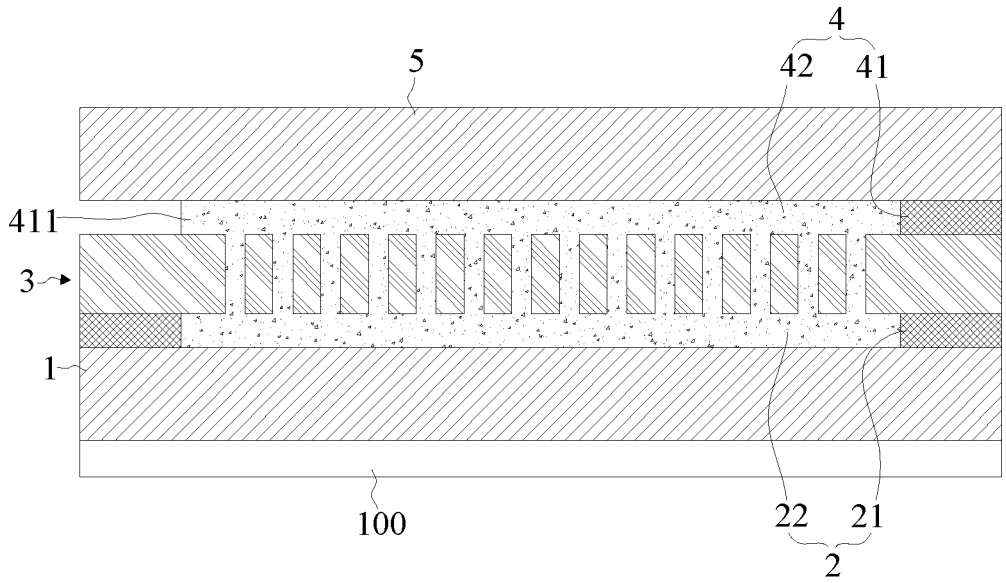
FIG. 16 is a diagram of step S260 in the manufacturing method of FIG. 11.

As shown in FIG. 16, the transparent filler may be in a liquid state. Since the display layer 3 has through-holes 301 that communicate the first cavity 200 and the second cavity 300, the transparent filler may be filled in the first cavity 200, the second cavity 300 and the through-holes 301. A portion of the transparent filler in the first plastic frame 21 is a first filling portion 22 and a portion of the transparent filler filled in the second plastic frame 41 is a second filling portion 42. The first filling portion 22 and the first plastic frame 21 form the first connection layer 2 and the second filling portion 42 and the second plastic frame 41 form the second connection layer 4.

In addition, the transparent filler may be cured by a curing process such as heat curing or light curing, so that the first filling portion 22 and the second filling portion 42 become solid. The first filling portion 22 and the second filling portion 42 may certainly be in a liquid state without being cured.

In step S270, the notch is blocked.

As shown in FIG. 2, a notch 411 may be sealed with the same material as that of the second plastic frame 41 to form a complete ring-shaped second plastic frame 41, thus preventing the transparent filler from leaking out. Other materials certainly may also be used to block the notch.

It should be noted that although the various steps of the method of the present disclosure are described in a particular order in the figures, it is not required or implied that the steps must be performed in the particular order, or all the illustrated steps must be performed to achieve the desired result. Additionally or alternatively, some steps may be omitted, or multiple steps may be combined into one step to be performed, and/or one step is decomposed into multiple steps to be performed.

An embodiment of the present disclosure provides a display device including the stretchable display panel in the above-described embodiment. The specific structure and beneficial effects of the stretchable display panel will not be elaborated here. The display device may be used in electronic devices such as mobile phones and tablet computers.

Other embodiments of the present disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and embodiments be considered as exemplary only, with a true scope and spirit of the present disclosure being indicated by the following claims.

What is claimed is:

1. A stretchable display panel, comprising:

a stretchable display layer comprising a display area and a non-display area surrounding the display area;

a first elastic layer disposed on a side of the display layer and connected to the non-display area by a first connecting part, the first connecting part being disposed in the non-display area; and a second elastic layer disposed on a side of the display layer distal to the first elastic layer and connected to the non-display area by a second connecting part, the second connecting part being disposed in the non-display area, wherein:

both the first elastic layer and the second elastic layer are transparent materials, the first elastic layer has a Young's modulus greater than that of the display layer, and the second elastic layer has a Young's modulus greater than that of the display layer;

the second elastic layer is fixedly connected to the non-display area through a second plastic frame;

the first connecting part comprises:

a first plastic frame sandwiched between the first elastic layer and the display layer, and located in the non-display area, the first plastic frame being in a ring-shape, wherein the first elastic layer is fixedly connected to the display layer through the first plastic frame; and a first filling portion filled in a space enclosed by the first plastic frame, and the first filling portion being liquid or solid having a Young's modulus is not greater than that of the display layer; and the second connecting part comprises the second plastic frame sandwiched between the second elastic layer and the display layer, and located in the non-display area, the second plastic frame being in a ring-shape.

2. The stretchable display panel according to claim 1, further comprising:

a second filling portion filled in a space enclosed by the second plastic frame, and the second filling portion being liquid or solid having a Young's modulus not greater than that of the display layer.

3. The stretchable display panel according to claim 2, wherein the display area of the display layer includes a plurality of display units that are spaced-apart and through-holes between the display units, wherein the first filling portion or the second filling portion is filled in the through-holes.

4. The stretchable display panel according to claim 2, wherein the first filling portion and the second filling portion are solid and the first filling portion and the second filling portion have a Young's modulus not less than 5 Mpa and not more than 500 Mpa.

5. The stretchable display panel according to claim 4, wherein a material of the first filling portion and the second filling portion comprises at least one of polyvinyl chloride, acrylic, and polysulfide.

6. The stretchable display panel according to claim 2, wherein the first filling portion and the second filling portion are liquid and the first filling portion and the second filling portion have a viscosity not less than 10 cps and not more than 1000 cps.

7. The stretchable display panel according to claim 6, wherein a material of the first filling portion and the second filling portion comprises a lubricating oil.

8. The stretchable display panel according to claim 1, wherein the Young's moduli of the first elastic layer and the second elastic layer are not less than 500 Mpa and not more than 5000 Mpa.

9. The stretchable display panel according to claim 1, wherein:

a material of the first elastic layer comprises at least one of polydimethylsiloxane, polyurethane, rubber, and polysulfide; and a material of the second elastic layer comprises at least one of polydimethylsiloxane, polyurethane, rubber, and polysulfide.

10. The stretchable display panel according to claim 1, wherein the first elastic layer and the second elastic layer have a thickness not less than 20 μm and not more than 200 μm; and the display layer has a thickness not less than 5 μm and not more than 20 μm.

11. A method for manufacturing a stretchable display panel, comprising any one of the following two schemes:

performing Scheme I of the two schemes, wherein performing Scheme I comprises:

providing a substrate and a stretchable display layer comprising a display area and a non-display area surrounding the display area;

forming a first elastic layer on the substrate, the first elastic layer being a transparent material and having a Young's modulus greater than a Young's modulus of the display layer;

forming a ring-shaped first plastic frame on a surface of the first elastic layer distal to the substrate, the first plastic frame being located in the non-display area;

filling a first filling portion in the first plastic frame, the first filling portion being liquid or solid having a Young's modulus not greater than that of the display layer;

providing the display layer on a surface of the first plastic frame distal to the substrate, wherein the first elastic layer is fixedly connected to the non-display area through the first plastic frame;

forming a ring-shaped second plastic frame on a surface of the display layer distal to the substrate, the second plastic frame being located in the non-display area;

forming a second elastic layer on a side of the second plastic frame distal to the substrate, the second elastic layer being fixedly connected to the non-display area through the second plastic frame, and the second elastic layer being a transparent material and having a Young's modulus greater than that of the display layer; and peeling off the substrate from the first elastic layer; and performing Scheme II of the two schemes, wherein performing Scheme II comprises:

providing a substrate and a stretchable display layer comprising a display area and a non-display area surrounding the display area;

forming a first elastic layer on the substrate, the first elastic layer being a transparent material and having a Young's modulus greater than a Young's modulus of the display layer;

forming a ring-shaped first plastic frame on a surface of the first elastic layer distal to the substrate, the first plastic frame being located in the non-display area;

providing the display layer on a surface of the first plastic frame distal to the substrate, wherein the first elastic layer is fixedly connected to the non-display area through the first plastic frame;

forming the second elastic layer on a side of the display layer distal to the substrate, and connecting the first elastic layer to the display layer by a first connecting part, comprises:

forming a ring-shaped second plastic frame on a surface of the display layer distal to the substrate, the second plastic frame being located in the non-display area, and the second plastic frame having a notch;

forming a second elastic layer on a surface of the second plastic frame distal to the substrate, the second elastic layer being fixedly connected to the non-display area through the second plastic frame;

injecting a transparent liquid filler into the notch to form a first filling portion in the first plastic frame;

blocking the notch; and peeling off the substrate from the first elastic layer.

12. The method according to claim 11, wherein performing Scheme I further comprises:

filling a second filling portion in the second plastic frame, before the second elastic layer is formed on the side of the second plastic frame distal to the substrate, after the ring-shaped second plastic frame is formed on the surface of the display layer distal to the substrate.

13. The method according to claim 11, wherein performing Scheme II further comprises:

injecting the transparent liquid filler into the notch to further form a second filling portion in the second plastic frame before the notch is blocked.

14. A display device, comprising:

a stretchable display panel, comprising:

a stretchable display layer comprising a display area and a non-display area surrounding the display area;

a first elastic layer disposed on a side of the display layer and connected to the non-display area by a first connecting part, the first connecting part being disposed in the non-display area; and a second elastic layer disposed on a side of the display layer distal to the first elastic layer and connected to the non-display area by a second connecting part, the second connecting part being disposed in the non-display area, wherein:

both the first elastic layer and the second elastic layer are transparent materials, the first elastic layer has a Young's modulus greater than that of the display layer, and the second elastic layer has a Young's modulus greater than that of the display layer;

the first connecting part comprises: a first plastic frame sandwiched between the first elastic layer and the display layer, and located in the non-display area, the first plastic frame being in a ring-shape, wherein the first elastic layer is fixedly connected to the display layer through the first plastic frame; and a first filling portion filled in a space enclosed by the first plastic frame, and the first filling portion being liquid or solid having a Young's modulus is not greater than that of the display layer; and the second connecting part comprises: a second plastic frame sandwiched between the second elastic layer and the display layer, and located in the non-display area, the second plastic frame being in a ring-shape, wherein the second elastic layer is fixedly connected to the non-display area through the second plastic frame.

* * * * *